US010912984B2

(12) United States Patent
Liao et al.

(10) Patent No.: US 10,912,984 B2
(45) Date of Patent: Feb. 9, 2021

(54) SLAT-BELT TREADMILL

(71) Applicants: Hung-Mao Liao, Taichung (TW); Joe Chen, Taichung (TW)

(72) Inventors: Hung-Mao Liao, Taichung (TW); Joe Chen, Taichung (TW)

(73) Assignee: Johnson Health Tech Co., Ltd., Taichung (TW)

( * ) Notice: Subject to any disclaimer, the term of this patent is extended or adjusted under 35 U.S.C. 154(b) by 28 days.

(21) Appl. No.: 16/174,291

(22) Filed: Oct. 30, 2018

(65) Prior Publication Data

US 2020/0129837 A1 Apr. 30, 2020

(51) Int. Cl.

| | |
|---|---|
| ***A63B 71/06*** | (2006.01) |
| ***A63B 22/02*** | (2006.01) |
| ***A63B 71/00*** | (2006.01) |
| ***A63B 24/00*** | (2006.01) |

(52) U.S. Cl.

CPC ..... *A63B 71/0622* (2013.01); *A63B 22/025* (2015.10); *A63B 22/0285* (2013.01); *A63B 24/0087* (2013.01); *A63B 71/0054* (2013.01); *A63B 2071/0081* (2013.01); *A63B 2209/00* (2013.01); *A63B 2225/74* (2020.08)

(58) Field of Classification Search

CPC ..... A63B 71/0622; A63B 22/025; A63B 22/0285; A63B 24/0087; A63B 71/0054; A63B 2207/02; A63B 2071/0081; A63B 2209/00; A63B 22/02–0264

See application file for complete search history.

(56) References Cited

U.S. PATENT DOCUMENTS

| | | | | |
|---|---|---|---|---|
| 2016/0371958 | A1* | 12/2016 | Munro | G08B 5/38 |
| 2017/0225038 | A1* | 8/2017 | Wei | A63B 22/02 |
| 2018/0140903 | A1* | 5/2018 | Poure | A63B 24/0075 |
| 2018/0236292 | A1* | 8/2018 | Bayerlein | A63B 21/0053 |
| 2019/0192915 | A1* | 6/2019 | Wei | A63B 22/02 |
| 2019/0351308 | A1* | 11/2019 | Fima | A63B 24/0087 |
| 2019/0351309 | A1* | 11/2019 | Fima | A63B 1/00 |

* cited by examiner

*Primary Examiner* — Andrew S Lo

(57) ABSTRACT

A slat-belt treadmill is provided. The slat-belt treadmill includes a treadmill frame, a front shaft pivotally coupled to the treadmill frame, and a rear shaft pivotally coupled to the treadmill frame; a plurality of slats constituting a slat-belt, collaboratively rotating about the front and rear shafts, and forming an exercise surface on which a user of the treadmill may walk or run; a driving apparatus coupling to the slats and driving the slats to rotate about the front and rear shafts; and a light-emitting unit disposed under the exercise surface to provide a light source. When the slats are rotating, light from the light-emitting unit is intermittently visible as the slats intermittently block and reveal the light.

6 Claims, 9 Drawing Sheets

SLAT-BELT TREADMILL

BACKGROUND

1. Field of the Invention

The present disclosure relates to a slat-belt treadmill. More particularly, the present disclosure relates to a slat-belt treadmill which includes a speed indicator to provide a visual reminder for people.

2. Description of the Related Art

In the field of physical exercise and rehabilitation, treadmills are common exercise apparatuses for fitness or rehabilitation. Generally, every treadmill has a treadmill frame including load bearing surfaces, a front shaft, and a rear shaft. Furthermore, an endless belt (or endless exercise surface) is mounted around the front and rear shafts and supported by the load bearing surfaces for a user walking or running thereon is also included.

A variation of this type of treadmill is called a slat-belt treadmill. A plurality of slats collaboratively aligned perpendicular to the moving direction replace the endless belt to constitute a slat-belt rotating about the front and rear shafts and to form an exercise surface upon which a user may walk or run.

FIG. 1 illustrates a perspective view of a slat-belt treadmill 100. The slat-belt treadmill 100 includes a treadmill frame 110. Compared to the treadmill having an endless belt, the slat-belt treadmill 100 has a plurality of individually independent slats 115 to constitute a slat-belt 119. FIG. 2 illustrates a partial view of an enlarged portion of the treadmill frame 110. According to FIG. 2, because there is a smaller contact area and friction between each slat 115 and the load bearing surfaces 118 of the treadmill frame 110, the slat-belt treadmill 100 has the following advantages such as low consumables cost, low noise operation, less belt and deck maintenance, and so on.

Because of the structure of the slat-belt treadmill 100, gaps 117 are formed between each two of the neighboring slats 115. A large permanent marking which is usually applied on the endless exercise surface to assist users in identifying whether a treadmill exercise surface is in motion is one good solution, but for slat-belt treadmills, it may be helpful to add additional features to assist users in identifying when a slat-belt treadmill exercise surface is in motion. This could be in addition to displaying a warning label in an obvious location that is visible to the user of the treadmill when it is in use.

SUMMARY

The object of the present disclosure provides a slat-belt treadmill which includes a speed indicator to provide a visual reminder for people that the exercise surface is in motion.

According to one embodiment of the present disclosure, a slat-belt treadmill is provided. The slat-belt treadmill includes a treadmill frame, a front shaft pivotally coupled to the treadmill frame, and a rear shaft pivotally coupled to the treadmill frame; a plurality of slats constituting a slat-belt, collaboratively rotatable about the front and rear shafts, and forming an exercise surface on which a user of the treadmill may walk or run; a driving apparatus coupling to the slats and driving the slats to rotate about the front and rear shafts; and a light-emitting unit disposed under the exercise surface to provide a light source. A translucent area is formed in the slat-belt, or the gaps between slats allows light to shine through the slat-belt, and when the slats are rotating, the light from the light source is viewable from the top surface of the exercise surface. The light source may also be alternately turned on and off at a chosen frequency or following a chosen light pattern.

In another embodiment of the present disclosure, the frequency or light pattern has a positive correlation with the rotating speed of the slats.

In another embodiment of the present disclosure, the gaps between slats allows light to shine through the slat-belt, and wherein the light shining through the gaps is visible from a rear end of the exercise surface.

In another embodiment of the present disclosure, the slat-belt treadmill further includes a light-shielding structure, and wherein when the slats are rotating, the light-shielding structure would block the light from shining through the gaps in the slat-belt in at least some locations.

In another embodiment of the present disclosure, the slat-belt treadmill further includes a control unit, and wherein the light-emitting unit is in communication with the control unit, and the control unit drives the light-emitting unit to emit light.

In another embodiment of the present disclosure, when the slats are rotating, the light-emitting unit is switched on and off alternately.

In another embodiment of the present disclosure, a time period between two nearest switched-on states of the light-emitting unit is larger than 1/16 second.

In another embodiment of the present disclosure, a time period between two nearest switched-on states of the light-emitting unit passing through the gaps in the slat-belt is larger than 1/16 second.

In another embodiment of the present disclosure, a portion of the slats is composed of a translucent material.

DETAIL DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Figure 1:
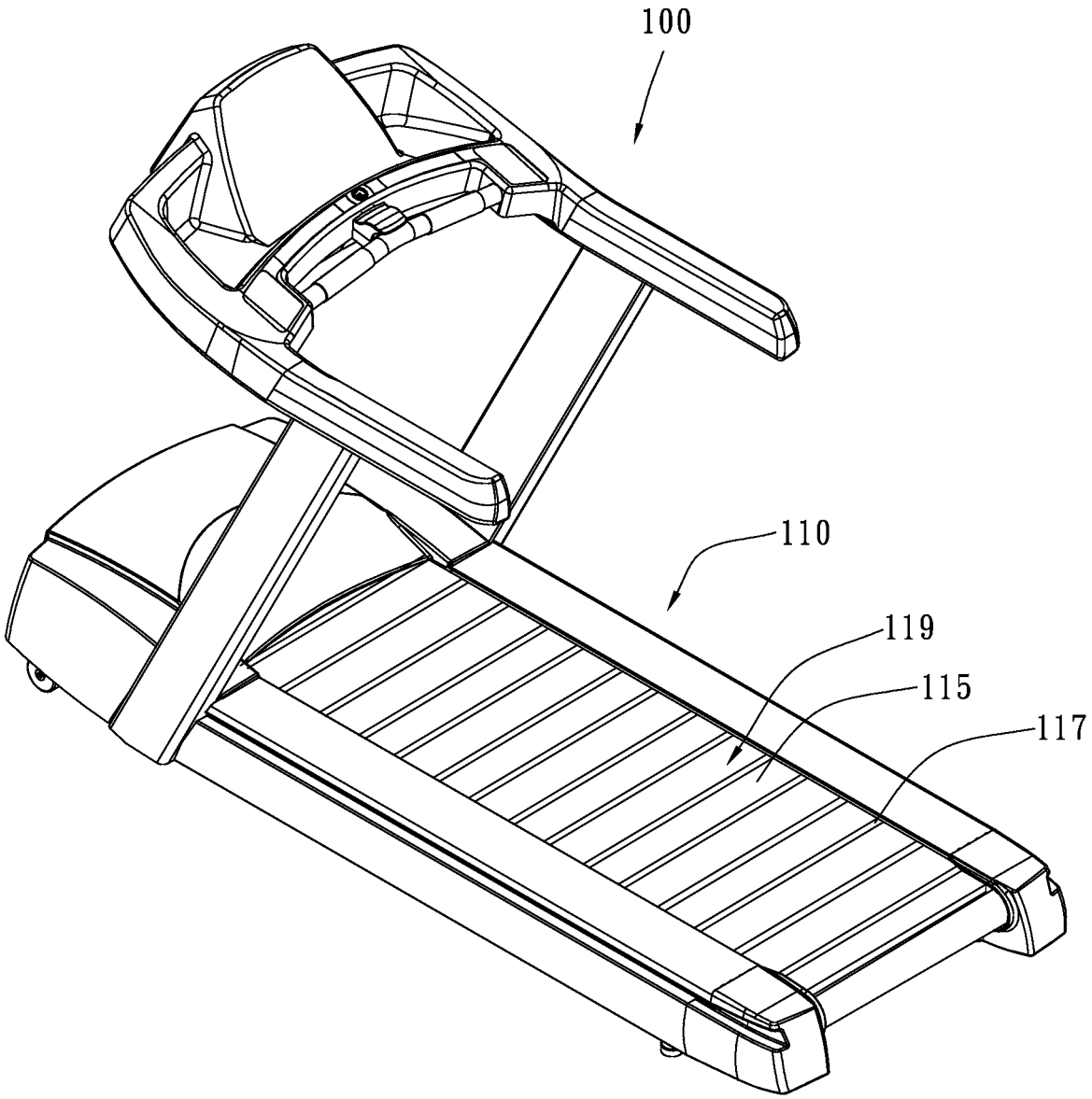
FIG. 1 Prior Art
FIG. 1 illustrates a perspective view of a conventional slat-belt treadmill.
Figure 2:
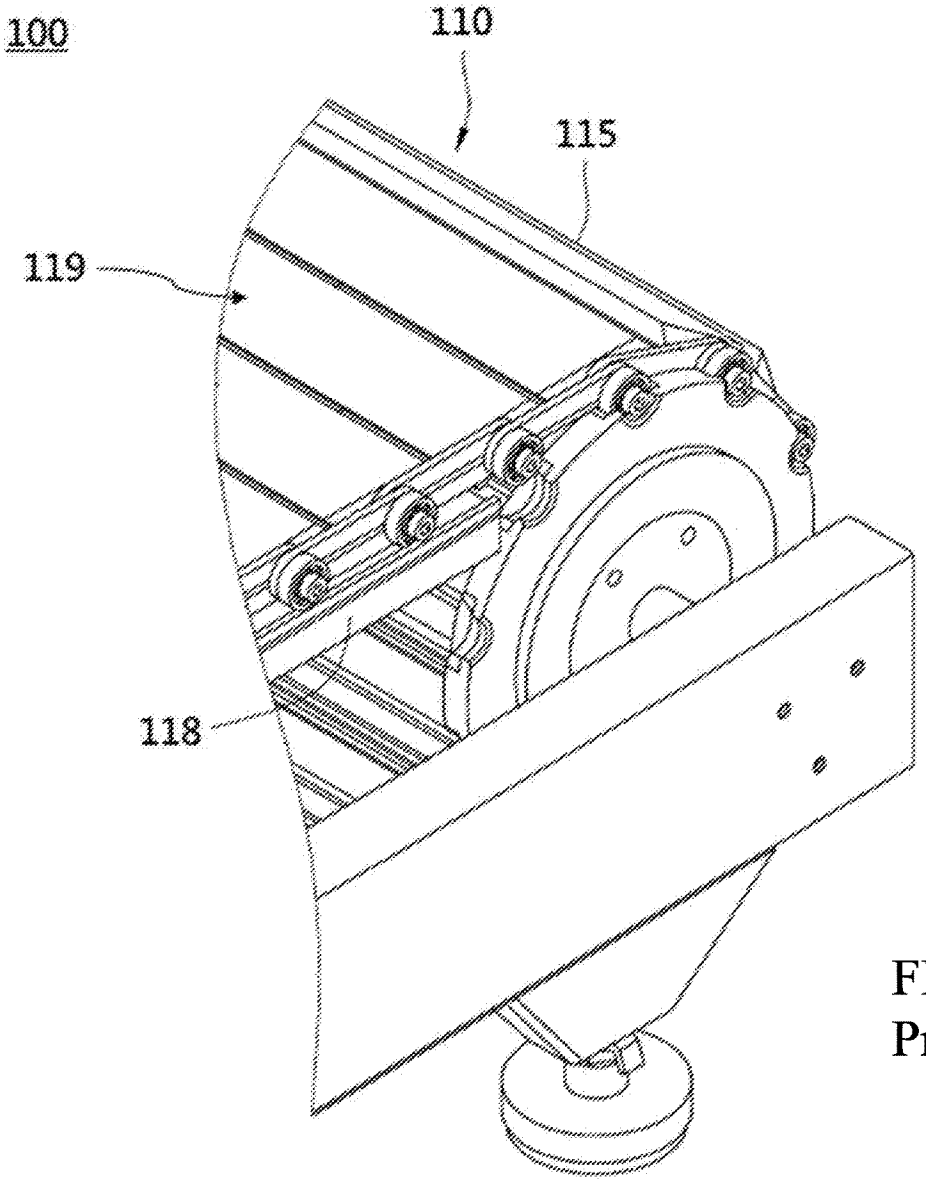
FIG. 2 Prior Art
FIG. 2 illustrates a partial view of a treadmill frame of a conventional slat-belt treadmill.
Figure 3:
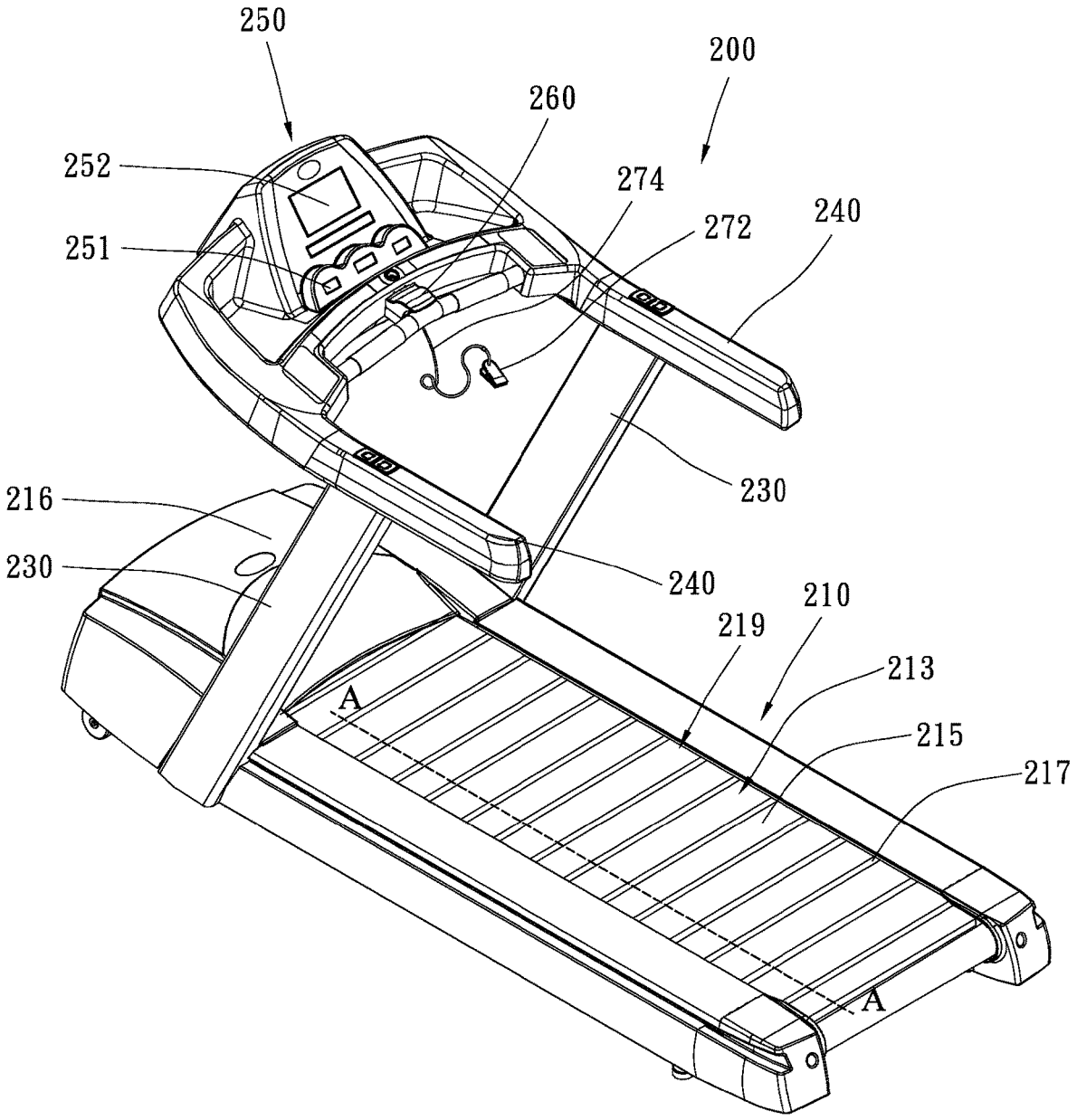
FIG. 3 illustrates a perspective view of a slat-belt treadmill according to the first embodiment of the present disclosure.
Figure 4:
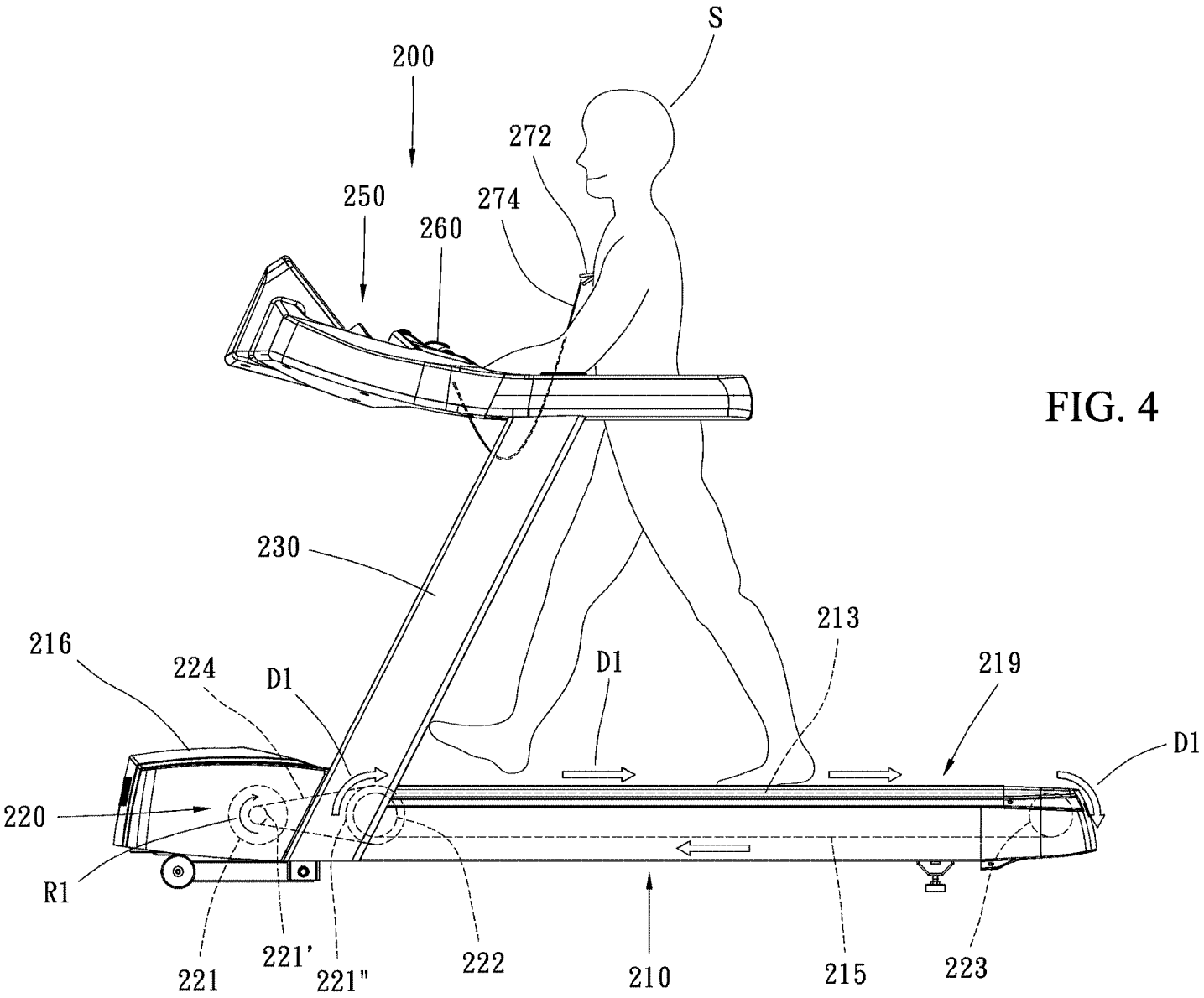
FIG. 4 illustrates a side view of a slat-belt treadmill according to the first embodiment of the present disclosure.

FIG. 3 illustrates a perspective view and FIG. 4 illustrates a side view of a slat-belt treadmill 200 in accordance with the first embodiment of the present disclosure. The slat-belt treadmill 200 is similar to a conventional slat-belt treadmill in appearance. The treadmill 200 includes a treadmill frame 210, two uprights 230 extending upwardly from left and right sides of the treadmill frame 210, two handrails 240 respectively mounted to the top ends of the two uprights 230, and a console 250.

The substantially rectangular treadmill frame 210 has a front end and a rear end. A front shaft 222 and a rear shaft 223 are pivotally and transversely mounted on the treadmill frame 210 and disposed at the front end and the rear end respectively. A plurality of rectangular slats 215 (shown in FIG. 3) collaboratively constitute a slat-belt 219 (shown in FIG. 3), rotate about the front shaft 222 and the rear shaft 223, and form an exercise surface 213 (shown in FIG. 3). The exercise surface 213 is slidable in a longitudinal direction. The exercise surface 213 is for supporting a user S and allowing the user S to walk or run thereon. In order to assist rotation of the slat-belt 219 around the front shaft 222 and the rear shaft 223, slats 215 are aligned individually with gaps 217 formed between each two of the neighboring slats 215.

In one embodiment of the present disclosure, the treadmill frame 210 can be manually or electromechanically adjusted to set the incline angle with respect to the ground, so that the user S can adjust the exercise surface 213 to a level state or to a chosen incline angle for simulating movement on level ground or on different slopes, respectively. The front end of the treadmill frame 210 in the present embodiment is provided with an electric control mechanism (not shown) for changing the angle thereof.

The exercise surfaces 213 in the drawings are presented at a horizontal state for illustrating a typical use of the slat-belt treadmill 200, which is not limited in the present disclosure. In other words, when the slat-belt treadmill 200 of the present embodiment is used, either simulating forward movement or simulating backward movement, the exercise surface 213 of the treadmill frame 210 may be adjusted to a level state, an inclined state such that the front end is higher than the rear end, or a declined state such that the front end is lower than the rear end according to the use requirement.

The treadmill frame 210 has a protecting cover 216 disposed at the front end thereof that covers the electric control mechanism that is provided to change the angle of the treadmill frame 210. The protecting cover 216 also covers a driving apparatus 220 that is configured to drive the slat-belt 219 (slats 215) to rotate about the front shaft 222 and the rear shaft 223. The driving apparatus 220 includes a motor 221 coupled to the slat-belt 219. Like a conventional treadmill transmission, a small belt pulley 221' is coupled to the motor shaft of the motor 221, a large belt pulley 221" is coupled to one side of the front shaft 222, and a driving belt 224 is mounted around the two belt pulleys 221', 221". As shown in FIG. 4, the motor 221 is controlled to run in a positive rotational direction R1 (shown as a clockwise direction in the figures), and the front shaft 222 is rotated in the same direction at a lower rotational speed and a higher torque. The front shaft 222 drives the slat-belt 219, rotating the slat-belt 219 in a positive rotational direction D1, so that the exercise surface 213 is moved backward toward the rear end. The motor 221 can also be run in a reverse rotational direction, and the front shaft 221' rotated in the same direction at a lower rotational speed and a higher torque, thereby driving the slat-belt 219 to be rotated in a reverse rotational direction opposite to the positive rotational direction D1, so that the exercise surface 213 is moved forward toward the front end. In order to rotate the slat-belt 219, the driving apparatus in the present disclosure can be replaced by any other conventional techniques.

Still referring to FIGS. 3-4, two lower ends of the two symmetric uprights 230 are respectively mounted to the left and right sides of the treadmill frame 210 near the front end of the exercise surface 213. In the present embodiment, each of the two uprights 230 extends upward and rearward from the treadmill frame 210.

The two symmetric handrails 240 are respectively supported by the top ends of the left and right uprights 230, and each extends substantially horizontally in a longitudinal direction at a height substantially corresponding to the waist or abdomen of a person of average height. The two symmetric handrails 240 allow the user S to support and stabilize themselves on or around the treadmill. In another embodiment (not shown), the left and right handrails may extend rearward to the rear end of the platform such that the length of the handrails 240 at the two sides of the slat-belt treadmill 200 are substantially equivalent in length to the length of the exercise surface 213.

The console 250 is secured between the upper ends of the left and right handrails 240, and located substantially above the protecting cover 216 at the front end of the treadmill frame 210. The console 250 includes a plurality of input interfaces 251 and a display interface 252 disposed thereof. The input interfaces 251 are provided to allow the user S to manually input commands, and the display interface 252 is provided to display information to the user S.

As shown in FIGS. 3-4, an emergency switch 260 is disposed at a central position of the console 250, and located on the side of the console 250 nearest to the user S. In the present embodiment, a rocker switch is used, and a large plastic cap is located over the emergency switch 260 and engaging with the emergency switch 260, so that pressing the plastic cap manually actuates the emergency switch 260 below the plastic cap. Actuating the emergency switch 260 cuts power to the motor 221, causing the slat-belt treadmill 200 to come to a stop in an emergency. Furthermore, a safety clip 272 is connected to one end (rear end) of a rope 274 with a predetermined length, and the other end (front end) of the rope 274 is connected to the plastic cap. When the rope 274 is pulled toward the rear end of the treadmill 200, the plastic cap is pulled in such a way as to actuate the emergency switch 260. The slat-belt treadmill in the present disclosure may use other emergency switches in place of the structure described above. For example, the emergency switch may use an alternative switch, a locking switch, a touch switch or a proximity sensor, or even an emergency switch installed in a wired or wireless controller which could be held by the user. Similarly, the rear end of the rope which is connected to the safety clip may be connected to a detachable member (e.g. a pin or magnet that is detachably in contact with the console), which may trigger a switch circuit when the rope is pulled taut, causing the detachable member to be removed from the console. The term "triggering" of a switch involves causing an electronic circuit to be short-circuited or open-circuited, or to change the electrical state from one level to another, such as a change in voltage, current, resistance, or capacitance.

The console 250 has a control unit therein (not shown). The control unit refers to a hardware, software and firmware assembly that can process a variety of electrical signals of the slat-belt treadmill 200 in a predetermined manner. In practice, a microcontroller (MCU) with a built-in specific program is generally used as the processing core, and the related circuits and components are integrated on one or more circuit boards. The control unit is in communication with the electric control mechanism (for changing the angle of the treadmill frame 210, not shown), the driving apparatus 220, the input interface 251, the display interface 252, and the emergency switch 260. The control unit is able to control the driving circuit of the motor 221 of the driving apparatus 220, such as commanding the motor 221 to start or stop operation and to control the rotational direction and rotational speed of the operation, making the driving apparatus 220 drive the slat-belt 219 to rotate in a predetermined rotational direction (for instance, the positive rotational direction D1) and a predetermined rotational speed. The control unit may also receive and process instructions or data from the input interface 251, control the display content of the display interface 252, and receive circuit signals from the emergency switch 260 (to monitor whether or not the emergency switch has been triggered).

Figure 5A:
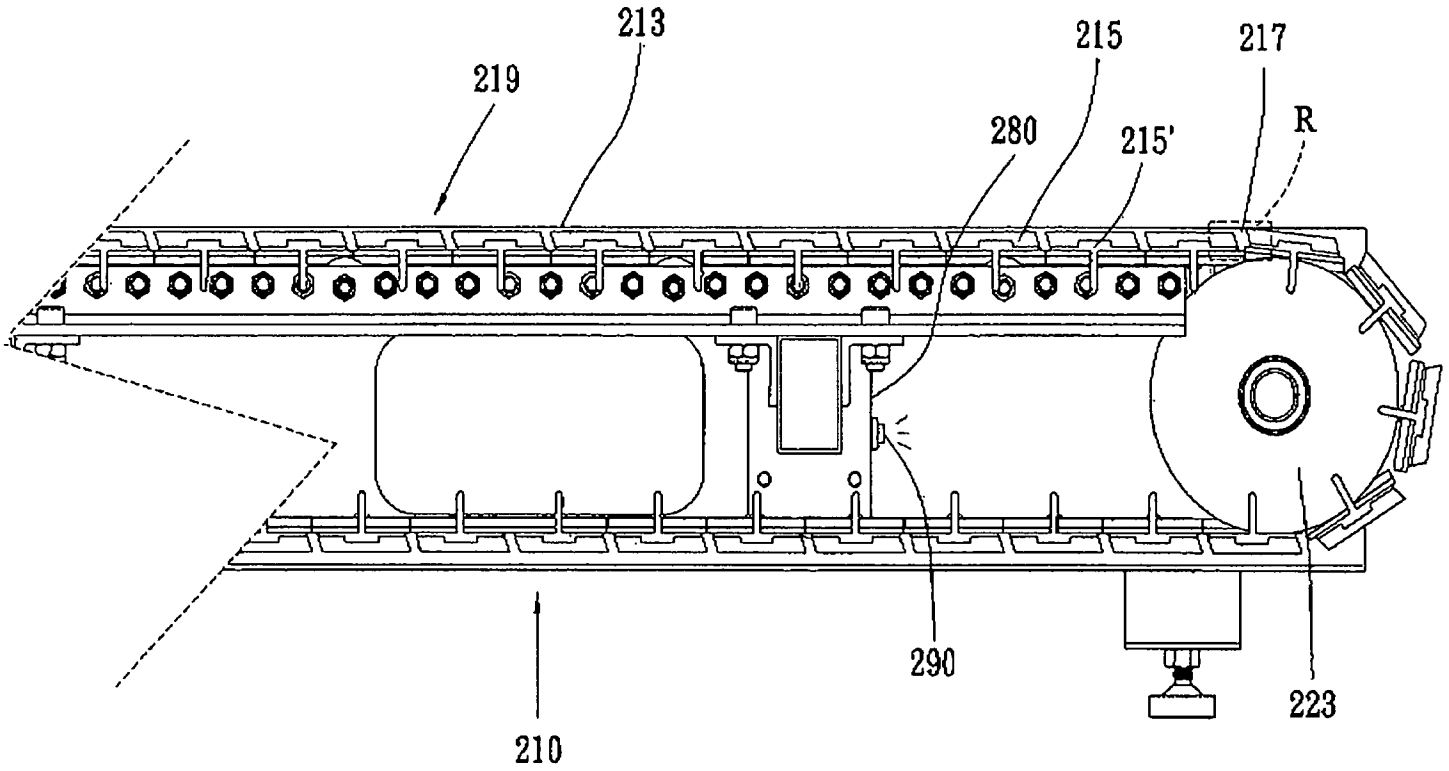
FIG. 5A illustrates a cross section view of an enlarged portion of a treadmill frame cutting along A-A line in FIG. 3 in the stationary status.

Referring to FIG. 5A, FIG. 5A is a cross section view of an enlarged portion of treadmill frame 210 cutting along line A-A in FIG. 3. A supporting rib 280 is transversely mounted in the treadmill frame 210 and disposed near the rear end of the treadmill frame 210. This supporting rib 280 connects the left side of the treadmill frame 210 to the right side of the treadmill frame 210, which increases the total supporting strength of the slat-belt treadmill 200. A slat supporting rib 215' is formed by extending inwardly from the surface of each slat 215 and substantially perpendicular to the surface thereof.

A light-emitting unit 290 is disposed on one side of the supporting rib 280. The light-emitting unit 290, when actuated, emits light from inside the treadmill frame 210 toward the slat-belt 219. In one embodiment, a translucent area R having a fixed position corresponding to the treadmill frame 210 is formed in the slat-belt 219. When the light-emitting unit 290 is actuated, the light emitted by the light-emitting unit 290 is capable of passing through the translucent area R. In another embodiment, the light emitted by the light-emitting unit 290 is capable of passing through gaps that are present between the individual slats 215, especially in the area near the rear end of the treadmill where the slat 215 rotates around the rear shaft 223, thereby increasing the size of the gaps between the individual slats 215.

In the embodiment, the light-emitting unit 290 is a single white light-emitting diode package electrically connected to the treadmill control unit, and the control unit actuates the light-emitting unit 290 to emit white light continuously. However, this is not a limitation in the present disclosure, and a person with ordinary skill in the art could make use of any other light-emitting unit, or a light-emitting unit that is actuated by an independent driving source in the slat-belt treadmill to be a light source instead. The properties of the light-emitting unit such as the emitting color, the brightness, the number of light-emitting units, the light-emitting angle, the main light-emitting direction, and so on could also be adjusted according to the necessity of the slat-belt treadmill. For example, some of the mentioned properties of the light-emitting unit could be achieved by choosing a different light source such as a light bulb, a light-emitting diode, a laser diode, and so on.

Still referring to FIG. 5A, it discloses a slat-belt treadmill 200 that is stationary (the slat-belt 219 is not moving). In the embodiment, the light-emitting unit 290 continuously emits white light in the slat-belt 219 and under the exercise surface 213 near the rear end of the treadmill frame 210. One or more gaps 217 are located near the rear end of the treadmill frame 210, allowing the light emitted by the light-emitting unit 290 to pass through the translucent area R via the one gap 217 continuously when the slat-belt 219 is not moving.

Figure 5B:
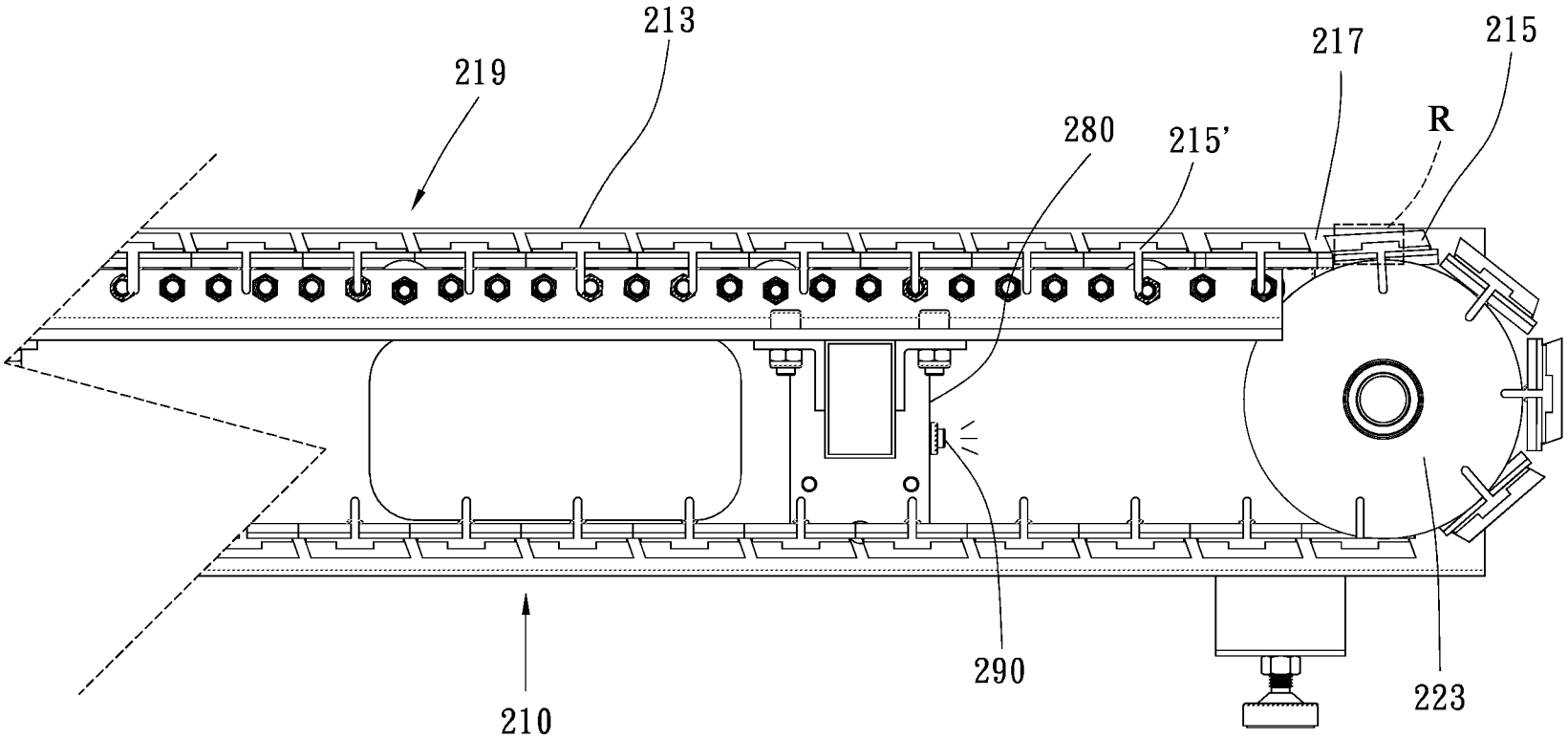
FIG. 5B illustrates a cross section view of an enlarged portion of a treadmill frame cutting along A-A line in FIG. 3 in the operating status with the slats of the slat-belt in a different location than that of FIG. 5A.

Now referring to FIG. 5B, FIG. 5B is a cross section view of an enlarged portion of treadmill frame 210 cutting along line A-A in FIG. 3 in the operating status. In other words, FIG. 5B discloses an operating status of the slat-belt treadmill 200 that is operational (the slat-belt 219 is moving). When the user S is exercising, the exercise surface 213 is moving backward toward the rear, and the slat-belt 219 is rotating in a positive rotational direction D1. Because the light-emitting unit 290 emits light continuously and the translucent area R is fixed corresponding to the treadmill frame 210, one slat 215 moves to cover the full translucent area R such that the light does not pass through the translucent area R in this moment.

When the slats 215 keep rotating, the slats 215 and the gaps 217 pass across the translucent area R alternatively with time. That is, when the slat-belt treadmill 200 starts to be operated, the light shining through the one or more gaps 217 would look as if it were blinking. Furthermore, when the rotation speed of the slat-belt 219 becomes faster, the blinking frequency of the light passing through the translucent area R becomes higher. In other words, when the slats 215 are rotating, the light transmission status such as the blinking frequency and/or the light pattern of the light-emitting unit 290 at the translucent area R is a time variable. The time variable has a positive correlation with the rotating speed of the slats 215.

In the embodiment, the translucent area R is located at a fixed position corresponding to the treadmill frame 210, so that the frequency of the blinking light passing through the translucent area R is a speed indicator to provide a visual reminder for a person viewing the slat-belt treadmill from a position approaching the slat-belt treadmill. Because the translucent area R is confined to be near the rear end of the exercise surface 213, the user S would not be able to see the light while walking or running on the exercise surface 213, and the light would therefore not interfere with the user S. However, the position of the translucent area R is not limited in the present disclosure, and a person with ordinary skill in the art could also arrange the locate the translucent area R in other locations, such as near the right side and/or the left side of the exercise surface 213 according to the necessity of the slat-belt treadmill 200.

In the embodiment, a person viewing the slat-belt treadmill from a position approaching the slat-belt treadmill could understand if the slat-belt of the slat-belt treadmill is rotating or not via visual observation. This visual indication of a moving exercise surface may allow a user S to avoid a sports-related injury due to stepping on or touching an operational slat-belt treadmill. In addition, the potential user, prior to mounting a slat-belt treadmill, could predict the rotating speed of the slat-belt treadmill by the blinking frequency of the light passing through the translucent area and therefore decide to step on the slat-belt treadmill directly or to stop the slat-belt prior to exercising.

According to the embodiment, when the rotating speed of the slats is faster, the blinking frequency of the light is higher and/or the light pattern at the translucent area is changing faster accordingly. However, if the blinking frequency is too high, due to the principle of persistence of vision, people will feel the light emitting continuously again. It could cause some confusion while using the slat-belt treadmill.

Figure 6:
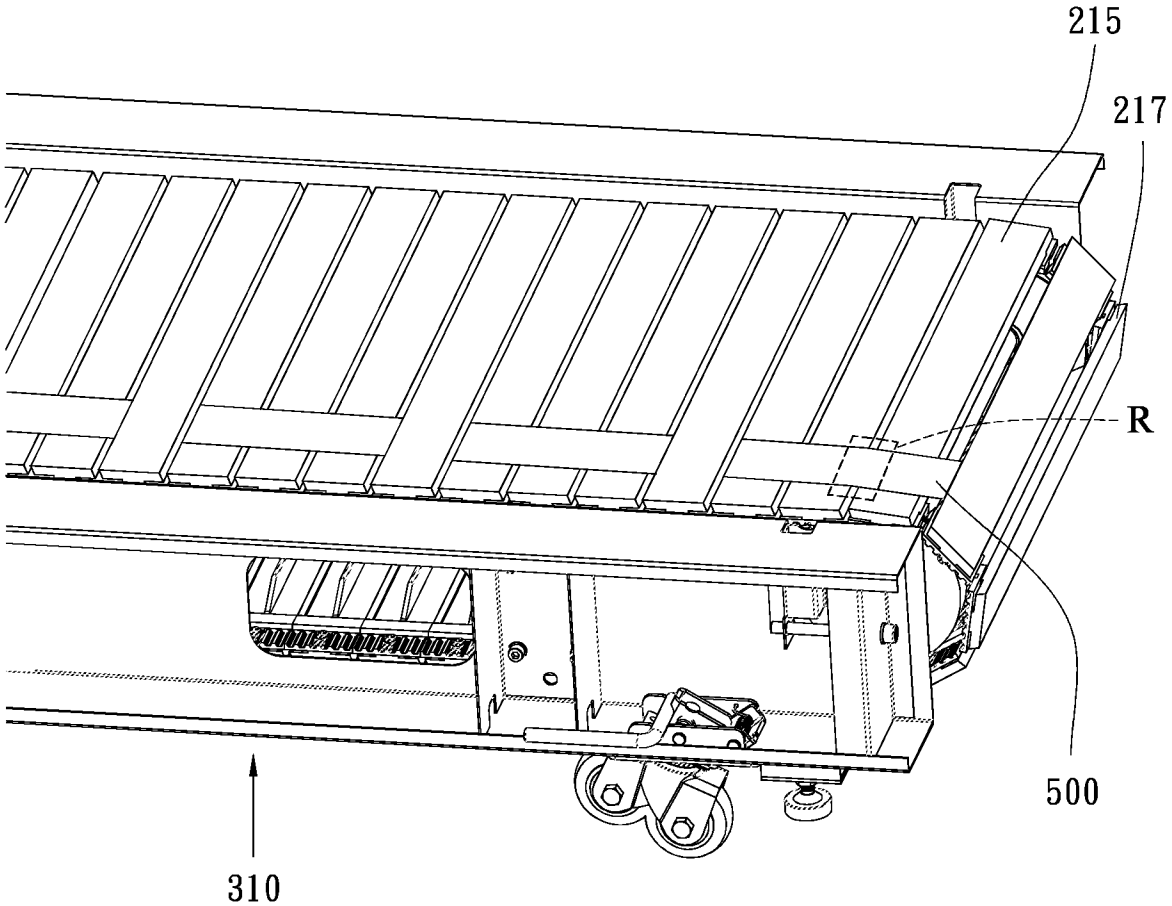
FIG. 6 illustrates a perspective view of an enlarged portion of a treadmill frame of a slat-belt treadmill according to the second embodiment of the present disclosure.

Referring to FIG. 6, FIG. 6 illustrates a perspective view of an enlarged portion of a treadmill frame 310 of a slat-belt treadmill in accordance with the second embodiment of the present disclosure. In the embodiment, except for the light-shielding structures 500, all the other structures are the same as the slat-belt treadmill 200 disclosed in the first embodiment and therefore the same labels are used and the same structures aren't described in detail again.

In this embodiment, the continuous light emitted from the light-emitting unit (not shown) is also capable of passing through the translucent area R. When the treadmill frame 310 of a slat-belt treadmill is in a stationary status, a person viewing the slat-belt treadmill from a position approaching the slat-belt treadmill could potentially see a continuous light emitting outwardly through the translucent area R, and when the slats 215 are rotating, a person viewing the slat-belt treadmill from a position approaching the slat-belt treadmill could see the light emitted and see it blinking through the translucent area R.

Different from the first embodiment, each of the light-shielding structures 500 is disposed with equally space on the slats 215 corresponding to the translucent area R. The light-shielding structures 500 has substantially the same width as the translucent area R. Based on this arrangement, when the slats 215 are rotating, the light-shielding structures 500 would pass across and block light from the translucent area R sequentially. In the example shown in FIG. 6, the light-shielding structures 500 are arranged in the order to shield three sequential gaps 217 leaving only one gap 217 for every four slats 215. In this example, the gaps 217 which are capable of letting the light be emitted are reduced.

In this embodiment, when the slats 215 are rotating, the blinking frequency of the light passing through the translucent area R becomes lower than that in the first embodiment, but the blinking frequency and/or the change of the light pattern at the translucent area R still has a positive correlation with the rotating speed of the slats 215. By taking advantage of the light-shielding structures 500 in the embodiment, a person viewing the slat-belt treadmill from a position approaching the slat-belt treadmill would be able to see a blinking light shining between the one or more gaps 217 even if the slat-belt treadmill is in use under a high rotating speed, allowing a person to predict the rotating speed of the slat-belt of the treadmill by the blinking frequency and/or the patterns of the light passing through the translucent area R.

In this embodiment, the material of the light-shielding structure 500 is the same as the slat 215. However, it is not limited in the present disclosure, and a person with ordinary skill in the art could change the material, the number of light-shielding structures 500, the disposed position, and the thickness of the light-shielding structures 500 according to the necessity of the slat-belt treadmill. For example, in one embodiment of the present disclosure, the number of the sequential gaps shielded and the number the following gaps exposed by each light-shielding structure could be changed according to the operating speed range of the slat-belt treadmill.

In another embodiment of the present disclosure, the light-shielding structures shield all the portions of the gaps. Instead, some portions of the slats are composed of a translucent material to form the translucent slat portions (not shown). In this embodiment, the blinking frequency, the light pattern, and/or the duration the light passing through the translucent area could be adjusted according to the shape and transparency of the translucent slat portions according to necessity.

Figure 7A:
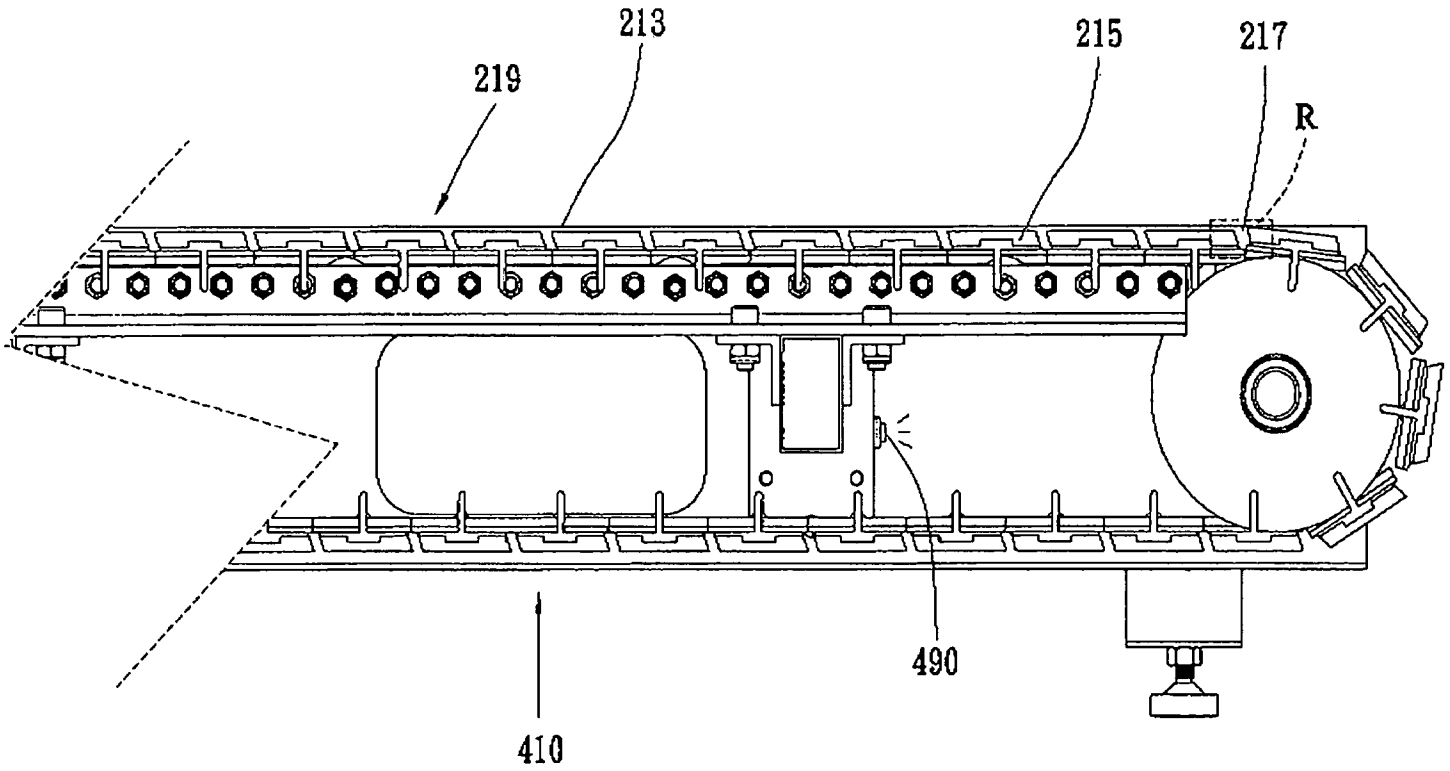
FIG. 7A illustrates a cross section view of an enlarged portion of a treadmill frame according to the third embodiment of the present disclosure in the stationary status.

Now referring to FIG. 7A, FIG. 7A illustrates a perspective view of an enlarged portion of a treadmill frame 410 of a slat-belt treadmill in the stationary status in accordance with another embodiment of the present disclosure. In this embodiment, except for the light-emitting unit 490, all the other structures are the same as the slat-belt treadmill 200 disclosed in the first embodiment and therefore the same labels are used and the same structures aren't described in detail again.

In FIG. 7A, the same as mentioned in the first embodiment, when the treadmill frame 410 of a slat-belt treadmill is in a stationary status, the light emitted continuously from the light-emitting unit 490 is capable of passing through the translucent area R via the gap 217, a person viewing the slat-belt treadmill from a position approaching the slat-belt treadmill would be able to see a continuous light emitting outwardly through the translucent area R the same as that shown in the first embodiment.

Figure 7B:
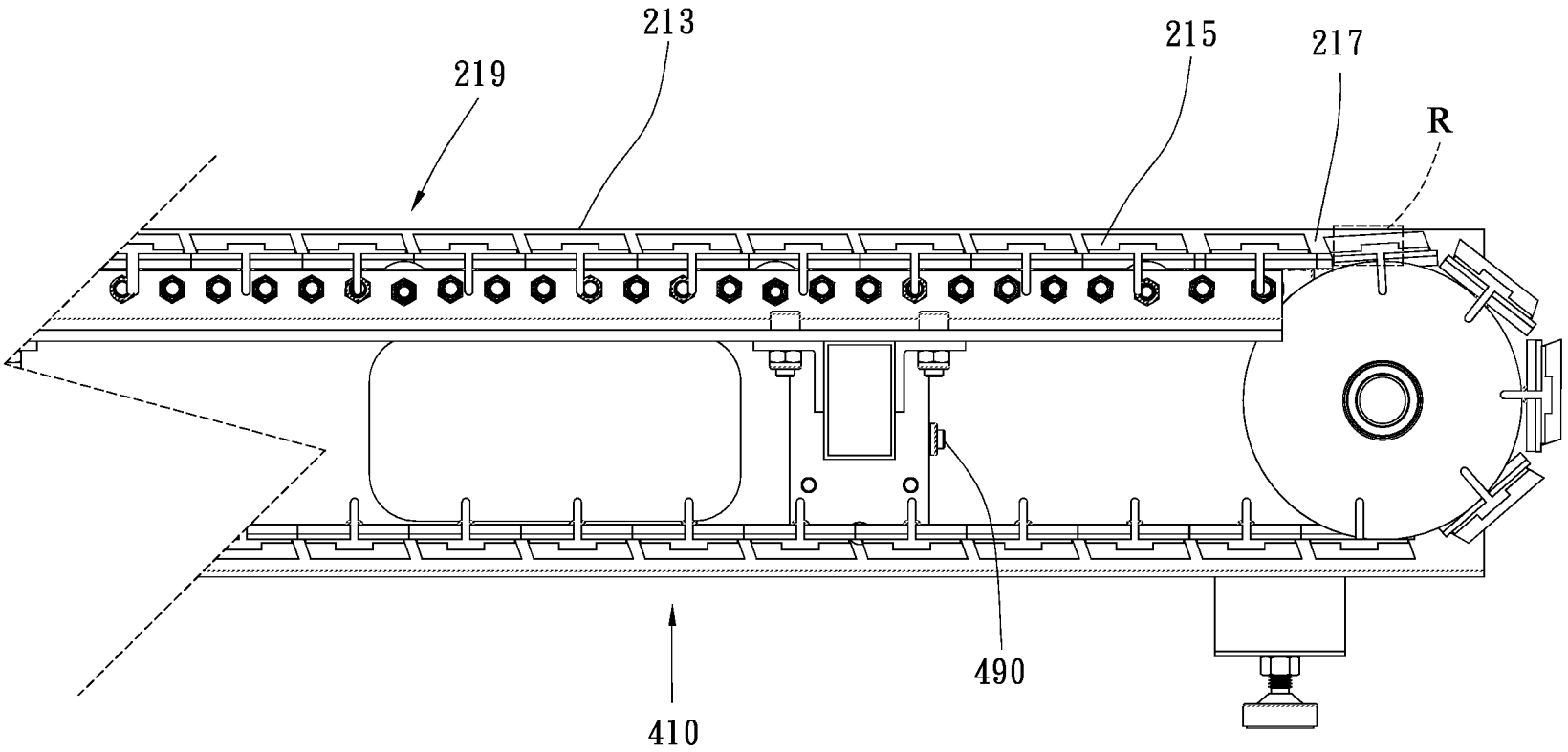
FIG. 7B illustrates a cross section view of an enlarged portion of a treadmill frame according to the third embodiment in the operating status with the light-emitting unit in a different state than that of FIG. 7A.

FIG. 7B is a cross section view of an enlarged portion of treadmill frame 410 in the operating status comparing to the stationary status shown in FIG. 7A. In other words, FIG. 7B discloses an operating status of the slat-belt treadmill that is operational (the slat-belt 219 is moving) When the user S is exercising, the exercise surface 213 is moving toward the rear end, and the slat-belt 219 is rotating in a positive rotational direction. As shown, one slat 215 moves to cover the full translucent area R in this moment. Different from the first embodiment, when the slat 215 is rotating to this position, the light-emitting unit 490 doesn't emit light in the slat-belt 219.

In this embodiment, by electrically connecting the light-emitting unit 490 and the control unit through circuit design, the light-emitting unit 490 is switched on when the gaps 217 passing through translucent area R and is switched off when the slats 215 passing through the translucent area R. In other words, the light-emitting unit 490 is electrically connected to and controlled by the control unit to switch on and off alternatively when the slats are rotating. Therefore, when the slat-belt 219 is rotating, a person viewing the slat-belt treadmill from a position approaching the slat-belt treadmill would be able to see the light blinking through the translucent area R. That is, in this embodiment, when the slats 215 are rotating, the light transmission status of the light-emitting unit 490 at the translucent area R is also a time variable. The time variable still has a positive correlation with the rotating speed of the slats 215.

In another embodiment of the present disclosure, the light-emitting unit 490, the control unit, and the slats 215 are further in communication with each other and able to send feedback signals to each other, so that the blinking frequency of the light-emitting unit 490 may be electrically controlled easily. For example, the light-emitting unit 490 could be switched on once when every four gaps passing through the translucent area R, so that the blinking frequency of the light passing through the translucent area R becomes lower than that in the first embodiment but still has a positive correlation with the rotating speed of the slats 215.

Taking advantage of the circuit design in the embodiment, even when the slat-belt treadmill is in use under a high rotating speed, a person viewing the slat-belt treadmill from a position approaching the slat-belt treadmill would still be able to predict the rotating speed of the slat-belt of the treadmill. By electrically controlling the blinking frequency of the light passing through the translucent area, the frequency of the blinking can be reduced to a low enough frequency that the blinking lights do not blur together for the person viewing the slat-belt treadmill.

In one embodiment, in order to prevent the principle of persistence of vision, the time period between two consecutive switched-on states of the light-emitting unit is greater than 1/16 second, which is the time that the image is likely to be retained in the brain. By reducing the frequency of the blinking light seen by a viewer, the individual blinks of light are less likely to blur together. In another embodiment, the time period between two consecutive states that the light-emitting unit emits light passing through the translucent area is larger than 1/16 second in order to prevent the principle of persistence of vision for a person viewing the slat-belt treadmill from a position approaching the slat-belt treadmill.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A slat-belt treadmill, comprising:

a treadmill frame;

a front shaft pivotally coupled to the treadmill frame;

a rear shaft pivotally coupled to the treadmill frame;

a plurality of slats constituting a slat-belt, collaboratively rotatable about the front and rear shafts, and forming an exercise surface on which a user may walk or run;

a driving apparatus coupling to the slats and driving the slats to rotate about the front and rear shafts; and a light-emitting unit disposed under the exercise surface to provide a light source;

wherein when the slats are rotating at a rotating speed, light from the light-emitting unit is intermittently visible as the slats intermittently block and reveal the light, wherein the light-emitting unit is switched on and off alternately, and a time period between two consecutive switched-on states of the light-emitting unit is larger than 1/16 second.

2. The slat-belt treadmill of claim 1, wherein the intermittently visible light has a frequency that has a positive correlation with the rotating speed.

3. The slat-belt treadmill of claim 1, wherein the intermittently visible light is only visible near a rear end of the exercise surface.

4. The slat-belt treadmill of claim 1, further comprising: a translucent area formed in the slat-belt and having a fixed position corresponding to the treadmill frame; and a light-shielding structure disposed on the slats, wherein when the slats are rotating, the light-shielding structure passes across and blocks light, so that a blinking frequency of the light passing through the translucent area is adjusted by the light-shielding structure.

5. The slat-belt treadmill of claim 1, further comprising a control unit, and wherein the light-emitting unit is in communication with the control unit, and the control unit drives the light-emitting unit to emit light.

6. The slat-belt treadmill of claim 1, wherein a portion of the slats is composed of a translucent material.

* * * * *